US012338647B2

(12) United States Patent
Wang

(10) Patent No.: US 12,338,647 B2
(45) Date of Patent: Jun. 24, 2025

(54) MULTI-FUNCTIONAL CURTAIN, CAMPING TARP AND TENT

(71) Applicant: Yebeho Outdoor Technology (Shenzhen) Co., Ltd., Shenzhen (CN)

(72) Inventor: Yuyin Wang, Shenzhen (CN)

(73) Assignee: Yebeho Outdoor Technology (Shenzhen) Co., Ltd., Shenzhen (CN)

( * ) Notice: Subject to any disclaimer, the term of this patent is extended or adjusted under 35 U.S.C. 154(b) by 0 days.

(21) Appl. No.: 18/949,052

(22) Filed: Nov. 15, 2024

(65) Prior Publication Data

US 2025/0075526 A1 Mar. 6, 2025

(30) Foreign Application Priority Data

Apr. 2, 2024 (CN) ..... 202410391827.3

(51) Int. Cl.
*E04H 15/30* (2006.01)
*E04H 15/54* (2006.01)

(52) U.S. Cl.
CPC ..... *E04H 15/54* (2013.01); *E04H 15/30* (2013.01)

(58) Field of Classification Search
CPC ..... E04H 15/30; E04H 15/54
See application file for complete search history.

(56) References Cited

U.S. PATENT DOCUMENTS 872,404 A * 12/1907 Burch ..... E04H 15/30 5/413 R
1,048,806 A * 12/1912 Burch ..... E04H 15/04 5/413 R
1,089,103 A * 3/1914 Barnard ..... E04H 15/30 160/354
1,260,612 A * 3/1918 Whall ..... E04H 15/30 135/117
1,658,214 A * 2/1928 Thomas ..... E04H 15/04 135/90
4,064,662 A * 12/1977 O'Toole ..... E04H 15/46 229/116
4,072,158 A * 2/1978 O'Brien ..... E04H 15/00 135/117
5,662,134 A * 9/1997 Auer ..... E04H 15/62 135/156
5,769,106 A * 6/1998 Achuff ..... A45F 4/02 135/97
7,134,443 B1 * 11/2006 Shires ..... E04H 15/36 135/117

(Continued)

*Primary Examiner* — Noah Chandler Hawk

(74) *Attorney, Agent, or Firm* — Westbridge IP LLC

(57) ABSTRACT

A multi-functional curtain includes an flysheet and an inner tent. The flysheet includes a body portion and two outer tent curtain portions arranged symmetrically. The inner tent includes a tent bottom and an inner tent curtain portion, where a tent curtain rim of the inner tent curtain portion is respectively connected to the tent bottom and the body portion. The tent bottom has a first inner tent rim detachably connected to the body portion, the tent bottom, the inner tent curtain portion and the body portion enclose an inner cavity after the first inner tent rim being separated from the body portion. The flysheet is formed with a plurality of corners. At least one of the corners is a connection corner of the body portion with two of the outer tent curtain portions, and a first inner tent rim of the tent bottom is detachably connected with the connection corner.

15 Claims, 5 Drawing Sheets

(56) References Cited

U.S. PATENT DOCUMENTS

| | | | | |
|---|---|---|---|---|
| 7,406,977 | B1 * | 8/2008 | Shires | E04H 15/26<br>135/121 |
| 10,837,195 | B2 * | 11/2020 | Wiseman | E04H 15/04 |
| 11,060,317 | B2 * | 7/2021 | Kojima | E04H 15/54 |
| 11,773,616 | B2 * | 10/2023 | Wowak | E04H 15/54<br>135/90 |
| 2008/0302403 | A1 * | 12/2008 | Stewart | E04H 15/04<br>135/114 |
| 2018/0283037 | A1 * | 10/2018 | McDonald | E04H 15/54 |
| 2020/0165835 | A1 * | 5/2020 | Shires | E04H 15/62 |

* cited by examiner

MULTI-FUNCTIONAL CURTAIN, CAMPING TARP AND TENT

CROSS-REFERENCE TO RELATED APPLICATIONS

This application claims priority to Chinese Patent Application No. 202410391827.3, filed on Apr. 2, 2024, the content of which is incorporated herein by reference in its entirety.

TECHNICAL FIELD

The present application relates to the field of outdoor products, and more particularly to a multi-functional curtain, camping tarp and tent.

BACKGROUND

In recent years, with an increasing number of outdoor enthusiasts and camping activities being increasingly mature, more and more people use camping tarps or camping tents outdoors. Among them, the camping tarp is a type of large outdoor equipment designed primarily for sun and rain protection while ensuring airflow, to enhance user convenience and comfort during outdoor activities; the camping tents are commonly used for camping, which can be pitched outdoors and create private space for accommodation of people overnight.

At present, the camping tarps and tents have become indispensable items in outdoor and camping activities, while the camping tarps and tents have become two basic necessities to provide shelter and camping.

However, existing camping tarps and tents are generally two products which need to be carried separately, and when a user uses these products, the two products are generally used separately or in combination.

When only carrying and pitching the tent product, the camping tarp cannot provide a closed cavity required for outdoor camping and accommodation, it cannot prevent entry of animals, insects and the like, and has poor warm and cold protection performance and weak wind resistance, it can only provide sheltered and relatively open activity space. When only carrying and pitching a tent product, under the conditions of the same mass and volume and fabric, the tent generally achieves a closed cavity through independent inner tent, some parts of the outer tent are pitched by additional struts to develop a function of roof similar to the camping tarp, but the shelter area and ventilation effect of this tent are much weaker than those of the camping tarp, there are usually more components, and it is complicated, time-consuming and clumsy to pitch and take in a tent, unable to provide a better activity space and is inconvenient to carry.

However, once carrying and using the two products of the camping tarp and the tent at the same time, it will not only increase the weight and volume of the equipment carried by the user, but also greatly increase the difficulty of pitching, and is tedious and time-consuming in storage, which is very unfriendly for the users of outdoor sports such as short-term travel, short-distance travel, light-weight hiking, climbing, riding, etc.

SUMMARY

The technical problem to be solved by the present application is as follows: a novel multi-functional curtain is provided, which achieves a multi-purpose of one product under different scenarios and requirements, i.e., the multi-functional curtain can not only be pitched to obtain a camping tarp, but also be pitched to obtain a tent, which has the advantages of lightweight, convenient to carry, easy to pitch and better applicability, etc. and can meet the user's requirements for the lightness of outdoor equipment, so that the user can obtain a better outdoor experience.

In order to solve the above-mentioned technical problem, the technical solution adopted by the present application is: a multi-functional curtain, including:

- an flysheet including a body portion and two outer tent curtain portions arranged symmetrically, where the body portion and the two outer tent curtain portions are connected to each other;
- an inner tent including a tent bottom and an inner tent curtain portion, where a tent curtain rim of the inner tent curtain portion is respectively connected to the tent bottom and the body portion; the inner tent is arranged in the body portion, and the tent bottom has a first inner tent rim detachably connected to the body portion, so that the tent bottom, the inner tent curtain portion and the body portion enclose an inner cavity after the first inner tent rim being separated from the body portion;
- where the flysheet is formed with a plurality of corners, each of the corners has two outer tent rims extending at an included angle to another adjacent corner, and each corner is further provided with an anchor point member for connecting a guy line, a tent stake or a support stem; at least one of the corners is a connection corner of the body portion with two of the outer tent curtain portions, and a first inner tent rim of the tent bottom is detachably connected with the connection corner.

Further, in the multi-functional curtain according to the present application, the connection corner is provided with a quick-release means, and the first inner tent rim of the tent bottom is detachably connected to the connection corner via the quick-release means.

Further, in the multi-functional curtain according to the present application, the flysheet is formed with six corners, the body portion is a quadrangular body portion, the two outer tent curtain portions are both triangular outer tent curtains, the two outer tent curtain portions are respectively connected to two adjacent rims of the body portion, and the corner formed by the connection of the outer tent rims of the two outer tent curtain portions is the connection corner.

Further, in the multi-functional curtain according to the present application, the tent bottom is a quadrangular tent bottom and the inner tent curtain portion is a triangular inner tent curtain; where the tent bottom includes the two first inner tent rims and the two second inner tent rims, the two first inner tent rims are detachably connected to the body portion, and the two second inner tent rims are connected to the body portion; the inner tent curtain portion includes a first tent curtain rim and two second tent curtain rims, the first tent curtain rim is connected to the tent bottom and the two second tent curtain rims are connected to the body portion.

Further, in the multi-functional curtain according to the present application, the flysheet is formed with eight corners, the body portion is a hexagonal body portion, the two outer tent curtain portions are triangular outer tent curtains, the two outer tent curtain portions are respectively connected with two adjacent rims of the body portion, and the corner formed where the outer tent rims of the two outer tent curtain portions are connected is the connection corner.

Further, in the multi-functional curtain according to the present application, the tent bottom is a hexagonal tent bottom and the inner tent curtain portion is a triangular inner tent curtain; where the tent bottom includes the two first inner tent rims and four second inner tent rims, the two first inner tent rims are detachably connected to the body portion, and the four second inner tent rims are connected to the body portion; the inner tent curtain portion includes a first tent curtain rim and two second tent curtain rims, the first tent curtain rim of the inner tent curtain portion is connected to the tent bottom and the two second tent curtain rims are connected to the body portion.

Further, in the multi-functional curtain according to the present application, the second inner tent rim of the tent bottom and the second tent curtain rim of the inner tent curtain portion are stitched to the body portion by a sewing thread.

Further, in the multi-functional curtain according to the present application, the tent bottom includes a waterproof fabric and a gauze for connection with the body portion, the gauze is provided at the periphery of a contour of the waterproof fabric; where the waterproof fabric further has a bending line therein, and the bending line is used for bending the waterproof fabric to obtain a horizontal portion arranged horizontally and a bending portion connected to the gauze when the tent bottom, the inner tent curtain portion and the body portion enclose an inner cavity.

Accordingly, the present application also discloses a completely new camping tarp, and both the camping tarp and the tent include the above-mentioned multi-functional curtain of the present application, which is easy to install and use. The camping tarp designed in the present application includes at least one support stem, a guy line and the above-mentioned multi-functional curtain of the present application, where all the inner tent rims of the tent bottom of the inner tent of the multi-functional curtain are connected to the body portion; where the inner tent curtain portion of the inner tent is accommodated between the tent bottom and the body portion interlayer, and at least one of the support stems is connected to at least one anchor point member on the flysheet of the multi-functional curtain to support the multi-functional curtain; the remaining anchor point members on the flysheet are connected to a guy line, and an end of the guy line away from the flysheet is fixed to the ground.

In addition, the present application also discloses a completely new tent, which specifically includes a support stem, tent stakes and the above-mentioned multi-functional curtain of the present application, where a first inner tent rim of the tent bottom of the inner tent of the multi-functional curtain is separated from the body portion, so that the tent bottom of the inner tent, the inner tent curtain portion and the body portion enclose an inner cavity; where the support stem is connected to an anchor point member provided at the connection corner to support the multi-functional curtain; and the remaining anchor point members on the body portion are fixed to the ground by the tent stakes.

The beneficial effects of the present application are as follows: the inventor provides a novel multi-functional curtain, which is easy to install and use; the multi-functional curtain achieves a multi-purpose of one product under different scenarios and requirements, i.e., the multi-functional curtain can not only be pitched to obtain a camping tarp, but also can be pitched to obtain a tent; an article can be pitched to obtain two important necessities (a camping tarp and a tent) to be able to cope with outdoor complex and varied scenarios; in addition, the multi-functional curtain has the advantages of light weight, being easy to carry, being easy to pitch and good applicability, which can meet the user's requirements for the lightness of outdoor equipment and make the user get better outdoor experience.

DETAILED DESCRIPTION OF THE EMBODIMENTS

Figure 1:
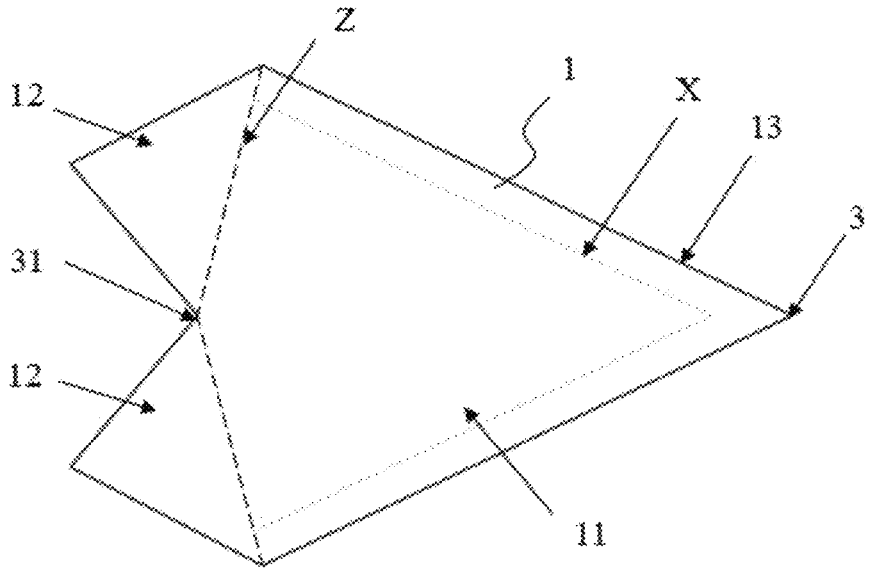
FIG. 1 is a structural top view showing a multi-functional curtain according to an embodiment of the present application.

In order to explain the technical contents, the objects, and the effects of the present application in detail, the embodiments will be described below referring to the accompanying drawings.

At present, outdoor enthusiasts generally carry a separate camping tarp or tent, and the separate camping tarp can only be fixed to the ground at most, and forms an open cavity with a bottom surface or a separate ground fabric; while individual tents generally achieve a closed cavity through an independent inner tent, some parts of the outer tent are pitched through a support stem to develop a function of roof similar to the camping tarp. The current users generally carry and use the above two products at the same time, which will not only increase the weight and volume, but also have the problems of tedious and time-consuming pitch and storage, which is very unfriendly for the users of outdoor sports such as short-term travel, short-distance travel, light weight hiking, climbing, riding.

In addition, the applicant has found that, when the current outdoor enthusiasts pitch tents, the process of pitching a separate inner tent to realize a closed cavity is very complicated, and therefore the inventor aims to improve and simplify the process of pitching an inner tent.

In this regard, referring to FIGS. 1 to 10, the present application designs a multi-functional curtain, including:

an flysheet 1 including a body portion 11 and two outer tent curtain portions 12 arranged symmetrically, where the body portion 11 and the two outer tent curtain portions 12 are connected to each other;

an inner tent 2 including a tent bottom 21 and an inner tent curtain portion 22, where a tent curtain rim of the inner tent curtain portion 22 is respectively connected to the tent bottom 21 and the body portion 11; the inner tent 2 is arranged in the body portion 11, and the tent bottom 21 has a first inner tent rim 213 detachably connected to the body portion 11, so that the tent bottom 21, the inner tent curtain portion 22 and the body portion 11 enclose an inner cavity after the first inner tent rim 213 being separated from the body portion 11;

where the flysheet 1 is formed with a plurality of corners 3, each of the corners 3 has two outer tent rims 13 extending at an included angle to another adjacent corner 3, and each corner 3 is further provided with an anchor point member for connecting a guy line, a tent stake or a support stem; at least one of the corners 3 is a connection corner 31 of the body portion 11 with two of the outer tent curtain portions 12, and a first inner tent rim 213 of the tent bottom 21 is detachably connected to the connection corner 31.

In the present application, the inventor has provided a completely new multi-functional curtain, where the multi-functional curtain includes an flysheet 1 and an inner tent 2, and at the same time, the flysheet 1 is provided to specifically include a body portion 11 and two symmetrically arranged outer tent curtain portions 12, where the body portion 11 and the two outer tent curtain portions 12 are connected to each other, and the inner tent curtain portion 22 in the inner tent 2 is controlled to be connected to a tent bottom 21 and the body portion 11 respectively, and the tent bottom 21 has a first inner tent rim 213 detachably connected to the body portion 11 of the flysheet 1; after the first inner tent rim 213 of the tent bottom 21 of the inner tent 2 is separated from the body portion 11, the tent bottom 21 and the inner tent curtain portion 22 of the inner tent 2 can be closed with the body portion 11 of the flysheet 1 to form a closed inner cavity, thereby further developing a function of the multi-functional curtain and enhancing the applicability thereof.

Accordingly, for ease of implementation, the two outer tent curtain portions 12 and the body portion 11 of the flysheet 1 may have a same connection point, and since the outer tent rims 13 of the two outer tent curtain portions 12 are connected at this point location, the outer tent rims 13 of the two outer tent curtain portions 12 can constitute a corner 3 at this point location, which is a connection corner 31 of the body portion 11 and the two outer tent curtain portions 12 of the flysheet 1. Meanwhile, in order to facilitate the deformation of the multi-functional curtain, the first inner tent rim 213 of the inner tent 2 may be configured to be detachably coupled to the connection corner 31.

It should be pointed out that in practice, the multi-functional curtain achieves a multi-purpose of one product under different scenarios and requirements, i.e., the multi-functional curtain can be pitched to obtain both a camping tarp and a tent.

When it is necessary to use the multi-functional curtain to pitch a camping tarp, a user can connect the multi-functional curtain to an anchor point member provided at at least one corner 3 on the flysheet 1 of the multi-functional curtain via at least one support stem 4, so that one end of the support stem 4 is connected to the anchor point member on the flysheet 1, and the other end of the support stem 4 is fixedly provided on the ground, thereby supporting the multi-functional curtain; at the same time, the remaining anchor point members on the flysheet 1 (including the anchor point members provided on the outer tent curtain portion 12) can be connected with the guy line, and one end of the guy line away from the flysheet 1 is fixed to the ground, so that the guy line and the above-mentioned support stem 4 are effectively used to fixedly arrange a camping tarp on the ground, and at this time, the multi-functional curtain mainly functions to shield, and at the same time, the camping tarp curtain needs to have a good ventilation function, and thus a cavity formed by the inner tent 2 and the body portion 11 of the flysheet 1 does not need to be closed, in this regard, when the multi-functional curtain is pitched as a camping tarp, all the inner tent rims of the tent bottom 21 in the inner tent 2 of the multi-functional curtain are connected with the body portion 11 of the flysheet 1, and the inner tent curtain portion 22 of the above-mentioned inner tent 2 is specifically accommodated between the interlayer of the tent bottom 21 and the body portion 11.

Accordingly, when it is necessary to use the multi-functional curtain to pitch a tent and perform camping sleep, a user also needs to use a support stem 4 to support the multi-functional curtain, but the length of the support stem 4 used at this time needs to be adjusted adaptively, and the first inner tent rim 213 of the tent bottom 21 in the inner tent 2 of the multi-functional curtain needs to be separated from the body portion 11 of the flysheet 1, so that an inner cavity is enclosed between the tent bottom 21 of the inner tent 2, the inner tent curtain portion 22 and the body portion 11 of the flysheet 1.

At this time, the support stem 4 can be connected with the anchor point members of the corner 3 (i.e., the connection corner 31) formed by connecting the outer tent rims 13 of the two outer tent curtain portions 12 to support the flysheet 1 of the multi-functional curtain, while allowing the remaining anchor point members on the body portion 11 of the flysheet 1 to be fixed to the ground via tent stakes. As a result, the tent bottom 21 of the inner tent 2 can be grounded and isolated from the ground, and at the same time, the inner tent curtain portion 22 connected to the tent bottom 21 can be vertically unfolded along with the dropping of the tent bottom 21, thereby ensuring that the tent bottom 21 of the inner tent 2, the inner tent curtain portion 22, and the body portion 11 of the flysheet 1 are enclosed to form a closed inner cavity.

In practice, the two outer tent curtain portions 12 of the flysheet 1 can choose whether to be fixed to the ground via a tent stake according to specific usage requirements, and the two outer tent curtain portions 12 can rotate to hang down or hang up; when the two outer tent curtain portions 12 are rotated to hang down, the operator can have two specific applications.

Figure 6:
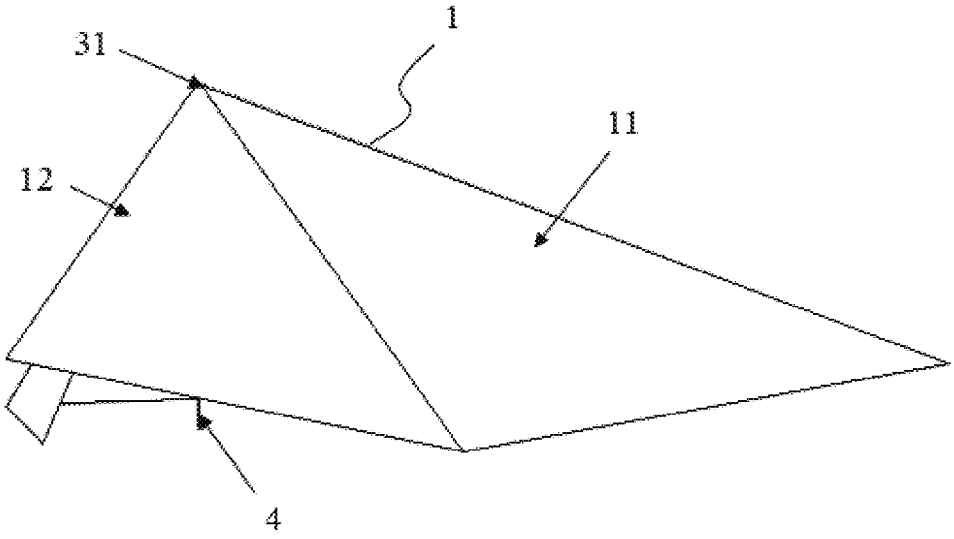
FIGS. 6 and 7 schematically show a schematic structural diagram showing two tent curtain portions open or closed of a tent according to an embodiment of the present application.

Firstly, as shown in FIG. 6, a user can control the anchor point member provided on the corner 3 of one of the outer tent curtain portions 12 to be fixed to the ground via a tent stake, while the other outer tent curtain portion 12 is not fixed to open and close freely, facilitating the user to enter and exit the tent (of course, the anchor point member provided on the corner 3 of the above-mentioned other outer tent curtain portion 12 can also be connected to the ground specifically via a guy line and control the opening and closing thereof under the interference of the user).

Figure 7:
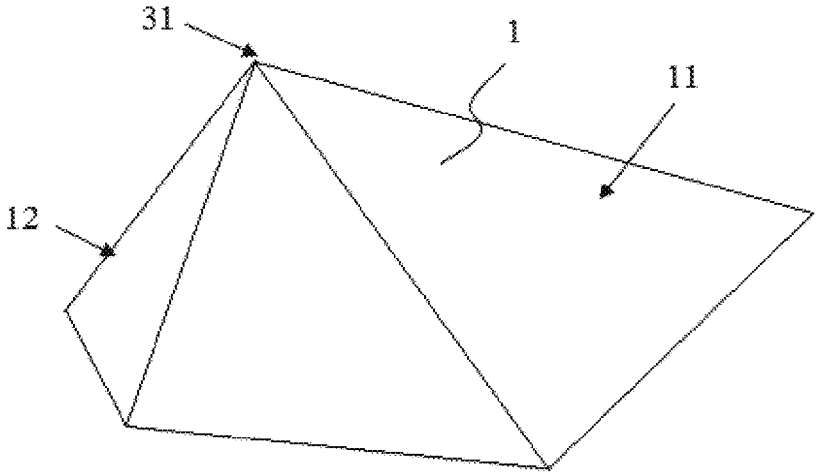

Secondly, as shown in FIG. 7, the user can control the anchor point members provided on the corners 3 of the two outer tent curtain portions 12 to be fixed to the ground via tent stakes, and allow the adjacent rims of the two outer tent curtain portions 12 to adhere to each other, and at the same time, a waterproof zipper can also be specifically provided on the adjacent rims of the two outer tent curtain portions 12 to be combined via the waterproof zipper to cooperate with the body portion 11 to close the flysheet 1 together, and at this time, double-layer protection can be achieved, and the user can move in the closed inner cavity enclosed by the inner tent curtain portion 22 and the body portion 11 and the tent bottom 21 of the inner tent 2; accordingly, depending on the particular use requirements, the two outer tent curtain portions 12 may also both be suspended, where the two outer tent curtain portions 12 allow the inner tent 2 to form an open inner cavity together with the body portion 11.

In addition, in practice, the inner tent curtain portion 22 may also be provided with a waterproof zipper 224, so that a user can open or close the tent bottom 21 and the closed inner cavity of the inner tent curtain portion 22 and the body portion 11 by pulling to open or pulling the waterproof zipper 224 on the inner tent curtain.

It should be pointed out that when the multi-functional curtain is pitched into a tent, and the tent bottom 21 and the inner tent curtain portion 22 of the inner tent 2 cooperate with the body portion 11 to form a closed inner cavity, the inner cavity of the multi-functional curtain is only closed in terms of a structural model, but due to the selection of the fabric, it does not affect ventilation between the inner cavity and the external environment, and a user can normally accommodate in the inner cavity, i.e., the tent pitched with the multi-functional curtain can achieve a closed inner cavity for sleeping and protecting, and at the same time ensure that the inner cavity can be ventilated.

At the same time, it should be pointed out that in practice, in order to improve the ventilation effect, the structure of the inner tent curtain portion 22 can also be improved, so that the inner tent curtain portion 22 includes an air-permeable screen window 222 and a guard 223, where the above-mentioned air-permeable screen window 222 is connected to the guard 223, and the guard 223 is provided at one end of the inner tent curtain portion 22 connected to the tent bottom 21, and the above-mentioned air-permeable screen window 222 is provided at one end of the inner tent curtain portion 22 connected to the body portion 11 of the flysheet 1. With this design, when the above-mentioned inner tent curtain portion 22 forms a closed inner cavity together with the tent bottom 21 and the body portion 11, it is still possible to exchange air with the external environment through the air-permeable screen window 222, in which case the two outer tent curtain portions 12 of the flysheet 1 of the multi-functional curtain can hang up, so as not to affect the air-permeability of the air-permeable screen window 222.

Figure 5:
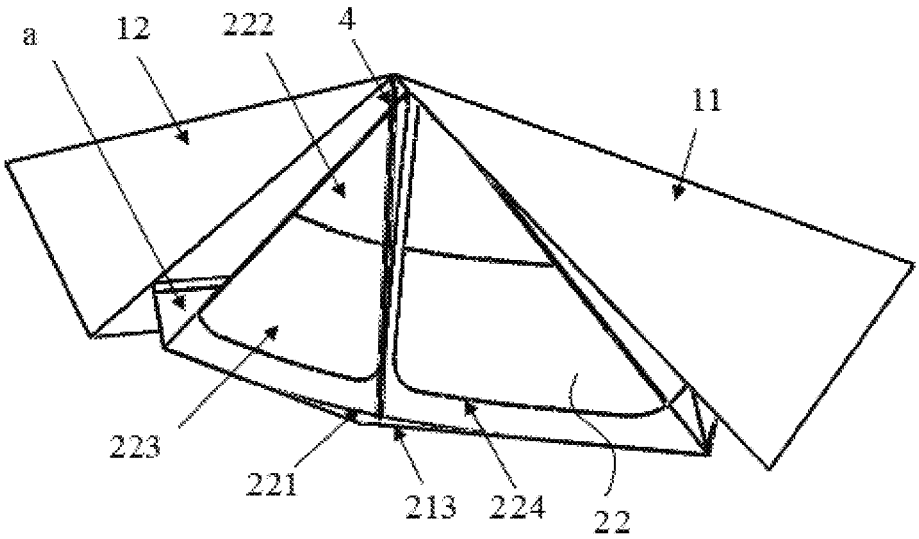
FIG. 5 is a schematic structural diagram showing a tent pitched with the multi-functional curtain as shown in FIG. 1.
Figure 8:
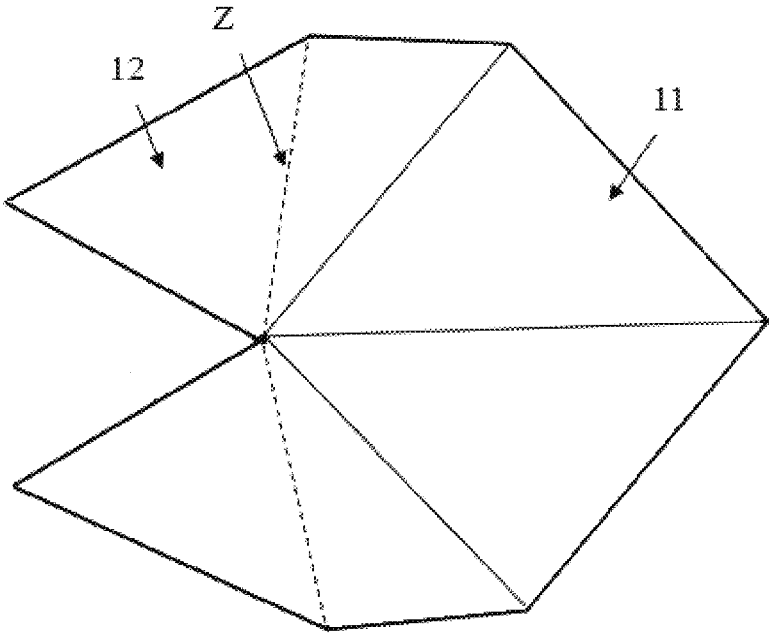
FIG. 8 is a structural top view showing an flysheet when a multi-functional curtain is pitched into a tent according to another embodiment of the present application.

As shown in FIGS. 5 and 8, when the multi-functional curtain is pitched into a tent, the inner tent curtain portion 22 can be unfolded normally to assume a triangular shape; however, when the multi-functional curtain does not pitch a tent, the user receives the multi-functional curtain, and the closed inner cavity enclosed by the inner tent 2 and the body portion 11 disappears, the connection end of the triangular inner tent curtain portion 22 and the inner tent 2 deform at the same time and form a folded area, so that when the first inner tent rim 213 of the tent bottom 21 is connected to the body portion 11, the inner tent curtain portion 22 overlaps between the interlayer of the tent bottom 21 and the body portion 11.

Accordingly, in the present application, an aperture of the air-permeable hole of the air-permeable screen window 222 can be set according to specific requirements, and the air-permeable screen window can not only permeate air but also effectively prevent mosquitoes from entering the inner cavity; a guard 223 connected to the air-permeable screen window 222 is provided, and the guard 223 is provided at one end of the inner tent curtain portion 22 connected to the tent bottom 21 to use the guard 223 for waterproof and windproof to improve the reliability of the tent pitched with the multi-functional curtain.

In addition, when the user encounters a severe environment such as a strong wind or rain, the user can lower the inner tent curtain portion 22 and the two outer tent curtain portions 12 of the flysheet 1 at the same time, thereby performing double protection using the outer tent curtain portion 12 and the inner tent curtain portion 22 to improve the windproof and waterproof performance of the tent.

In addition, it needs to be stated that in practice, considering the application of outdoor scenarios, in order to support the above-mentioned multi-functional curtain, a telescopic support stem can also be specifically used to cooperate with the deformation of the multi-functional curtain in the present application, and the length of the support stem 4 can be 1.4 m, 2.0 m or 2.6 m, and this length can meet the support length requirements for the multi-functional curtain to pitch a camping tarp or tent, which has a better applicability.

Of course, it is important to point out that in practice, the length of the above-mentioned support stem 4 is not limited by a specific numerical value, and support stems of various height models can be selected to support the camping tarp or tent according to the camping tarp or tent to be pitched; meanwhile, the inner tent curtain portion 22 may be detachably connected to the tent bottom 21 and the body portion 11 according to the requirements, in particular, for the convenience of use.

It can be seen therefrom that, with this design, the multi-functional curtain designed in the present application is easy to install and use, and the multi-functional curtain can achieve a multi-purpose of one product under different scenarios and requirements, i.e., the multi-functional curtain can not only be pitched to obtain a camping tarp, but also can be pitched to obtain a tent; an article can be pitched to obtain two important necessities (a camping tarp or a tent) to be able to cope with outdoor complex and varied scenarios.

Further, in the multi-functional curtain according to the present application, the connection corner 31 is further provided with a quick-release means, and the first inner tent rim 213 of the tent bottom 21 is detachably connected to the connection corner 31 by the quick-release means.

Further, in the multi-functional curtain of the present application, the flysheet 1 is formed with six corners 3, the body portion 11 is a quadrangular body portion 11, the two outer tent curtain portions 12 are both triangular curtains, the two outer tent curtain portions 12 are respectively connected to two adjacent rims (dotted lines Z shown in FIG. 1) of the body portion 11, and the corner 3 formed by the connection of the outer tent rims 13 of the two outer tent curtain portions 12 is the connection corner 31.

It should be pointed out that in the actual design, the inventor conducted a large number of long-term practical studies on the time and scenario and demand state, and disassembled and reconstructed the appearance of the multi-functional curtain; at the same time, a large number of calculations and experiments are carried out to design and determine the method logic and solution model of the constant and variable axial position, displacement trajectory and folding, disassembling, fitting and cavity-sealing state of the body portion 11 of the flysheet 1 and the symmetrically arranged two outer tent curtain portions 12 and the tent bottom 21 and the inner tent curtain portion 22 of the inner tent 2 in three-dimensional space by means of the mathematical model of multiple summation and equality, and finally a multi-functional curtain with a reasonable shape and excellent use effect is obtained.

Figure 2:
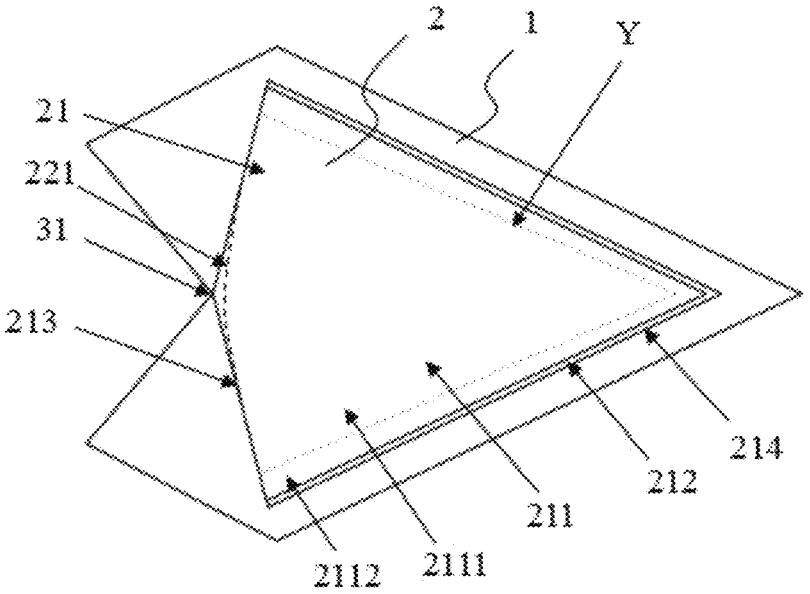
FIG. 2 is a structural bottom view showing an inner tent of a multi-functional curtain arranged in a body portion of an flysheet according to an embodiment of the present application.

Referring to FIGS. 1 and 2, in the multi-functional curtain, the flysheet 1 is specifically formed with six corners 3, and the two outer tent curtain portions 12 are both triangular tent curtains (the dotted line Z shown in FIG. 1 schematically divides a contour of the outer tent curtain portion 12 in the flysheet 1), the body portion 11 is a quadrilateral body portion 11, and the corner 3 formed where the outer tent rims 13 of the two outer tent curtain portions 12 are connected is a connection corner 31 of the body portion 11 of the flysheet 1 and the two outer tent curtain portions 12, i.e., a place where the outer tent rims 13 of the two outer tent curtain portions 12 are connected is a common connection point of the two outer tent curtain portions 12 and the body portion 11, and the corner 3 here is the above-mentioned connection corner 31.

In the present embodiment, an angular bisector of the corner 3 formed where the outer tent rims 13 of the two outer tent curtain portions 12 are connected is a symmetry axis of the two outer tent curtain portions 12, and the above-mentioned quadrangular body portion 11 can also be symmetrical up and down along the above-mentioned angular bisector, i.e., the flysheet 1 of the multi-functional curtain designed in the present application can be symmetrically arranged up and down along the angular bisector of the corner 3 formed where the outer tent rims 13 of the two outer tent curtain portions 12 are connected.

Of course, in the multi-functional curtain designed in the present application, in order to obtain a better implementation effect, the inner tent 2 provided in the body portion 11 of the outer tent rim 13 may also be arranged symmetrically up and down along the angular bisector, i.e., both the tent bottom 21 and the inner tent curtain portion 22 of the inner tent 2 may be arranged symmetrically up and down along the angular bisector.

Further, in the multi-functional curtain according to the present application, the tent bottom 21 is a quadrangular tent bottom 21 and the inner tent curtain portion 22 is a triangular inner tent curtain; where the tent bottom 21 includes the two first inner tent rims 213 and two second inner tent rims 214, the two first inner tent rims 213 are detachably connected to the body portion 11, and the two second inner tent rims 214 are connected to the body portion 11; the inner tent curtain portion 22 includes a first tent curtain rim 221 and two second curtain rims, the first tent curtain rim 221 is connected to the tent bottom 21 and the two second curtain rims are connected to the body portion 11.

In the above-mentioned technical solution of the present application, the above-mentioned inner tent 2 may also specifically select the tent bottom 21 to be a quadrangular tent bottom 21, and the inner tent curtain portion 22 to be a triangular inner tent curtain; where a horizontal projection area of the tent bottom 21 is smaller than a horizontal projection area of the body portion 11, so that the tent bottom 21 and the inner tent curtain portion 22 of the inner tent 2 can be laid together in the body portion 11 of the flysheet 1.

It should be pointed out that when the tent bottom 21 is a quadrangular tent bottom 21, a fabric corner of the quadrangular tent bottom 21 can be detachably connected to the above-mentioned connection corner 31, at this time, two first inner tent rims 213 extending at an included angle of the above-mentioned fabric corner are detachably connected to the connection corner 31, and the first inner tent rims 213 are also detachably connected to the body portion 11; and the other two second inner tent rims 214 are fixedly connected to the body portion 11 of the outer tent rims 13 on the whole rim to ensure that, after the two first inner tent rims 213 of the quadrangular inner tent 2 are separated from the body portion 11, the tent bottom 21 of the inner tent 2 can be grounded and isolated from the ground, and at the same time, the inner tent curtain portion 22 connected to the tent bottom 21 of the inner tent 2 can be vertically unfolded along with the drop of the tent bottom 21, so that the tent bottom 21 of the inner tent 2, the inner tent curtain portion 22 and the body portion 11 of the flysheet 1 are enclosed and form a closed inner cavity.

It should be noted that in some other embodiments, the body portion 11 of the flysheet 1 may be formed without the quadrangular body portion 11, and the tent bottom 21 of the inner tent 2 may be formed without the quadrangular tent bottom 21, and may be formed in other shapes, so that the above advantages and advantageous effects can be achieved.

Figure 9:
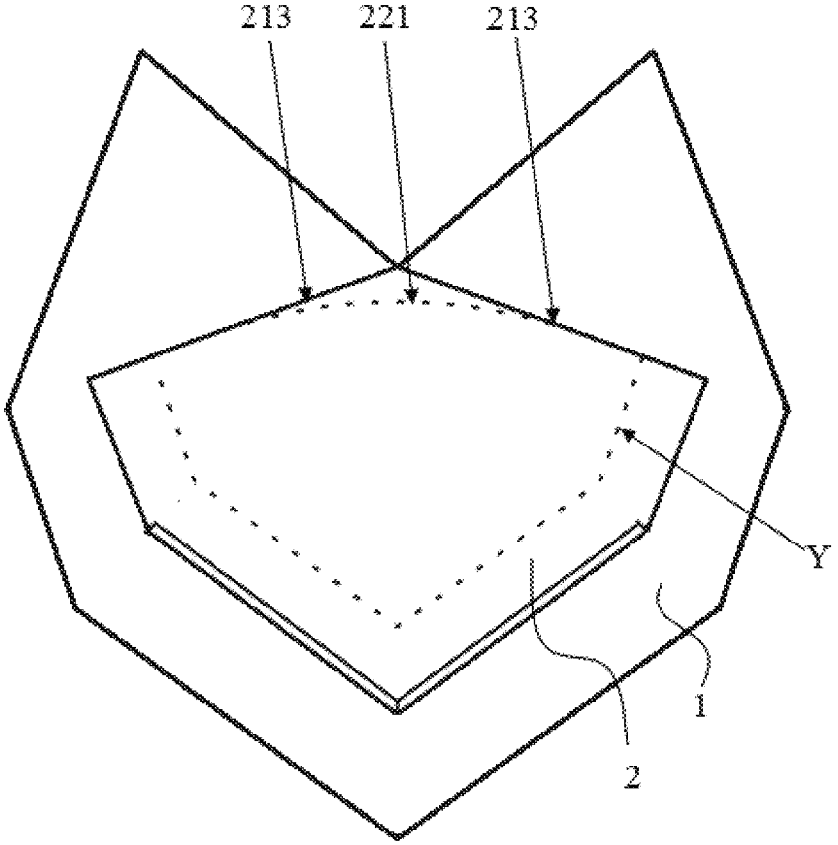
FIG. 9 is a structural bottom view showing an inner tent of a multi-functional curtain provided in a body portion of an flysheet according to another embodiment of the present application.
Figure 10:
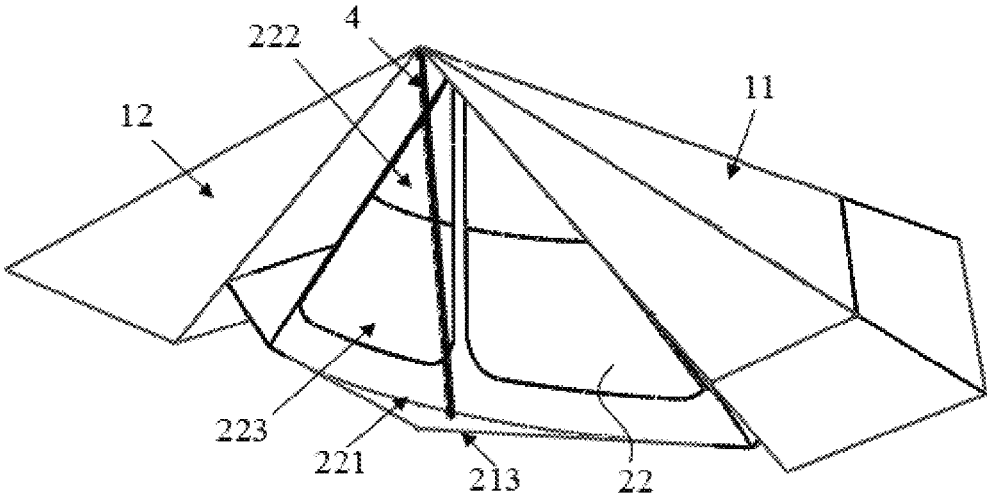
FIG. 10 is a schematic structural diagram showing the tent pitched with the multi-functional curtain as shown in FIG. 8.

For example, as shown in FIGS. 8, 9 and 10, in the multi-functional curtain described in the present application, the above-mentioned flysheet 1 can also be specifically formed with eight corners 3; in this case, the body portion 11 is specifically a hexagonal body portion 11; the two outer tent curtain portions 12 are triangular outer tent curtain portions 12; the two outer tent curtain portions 12 are respectively connected to two adjacent rims of the body portion 11 (i.e., the broken line Z shown in FIG. 1); and the corner 3 formed by the connection of the outer tent rims 13 of the two outer tent curtain portions 12 is the connection corner 31.

At this time, the tent bottom 21 of the inner tent 2 may also be specifically a hexagonal tent bottom 21, and the inner tent curtain portion 22 is a triangular inner tent curtain; where the tent bottom 21 includes the two first inner tent rims 213 and four second inner tent rims 214, the two first inner tent rims 213 are detachably connected to the body portion 11, and the four second inner tent rims 214 are connected to the body portion 11; the inner tent curtain portion 22 includes a first tent curtain rim 221 and two second curtain rims, the first tent curtain rim 221 of the inner tent curtain portion 22 is connected to the tent bottom 21 and the two second curtain rims are connected to the body portion 11.

Further, in the multi-functional curtain according to the present application, the second inner tent rim 214 of the tent bottom 21 and the second tent curtain rim of the inner tent curtain portion 22 are stitched to the body portion 11 by a sewing thread.

Further, in the multi-functional curtain according to the present application, the tent bottom 21 includes a waterproof fabric 211 and a gauze 212 for connection with the body portion 11, the gauze 212 is provided at the periphery of a contour of the waterproof fabric 211; where the waterproof fabric 211 also has a bending line therein, and the bending line is used for bending the waterproof fabric 211 to obtain a horizontal portion 2111 arranged horizontally and a bending portion 2112 connected to the gauze 212 when the tent bottom 21, the inner tent curtain portion 22 and the body portion 11 enclose an inner cavity.

When the multi-functional curtain is used, the multi-functional curtain can be pitched into a tent, and after the tent is pitched, it is necessary to use a closed inner cavity formed by the enclosure between the inner tent 2 and the body portion 11 of the flysheet 1 for a user to accommodate, and therefore the tent bottom 21 of the inner tent 2 needs to be grounded and isolated from the ground.

In order to ensure that water stains on the ground do not penetrate the tent bottom 21, when provided, the tent bottom 21 may include a waterproof fabric 211 and a gauze 212 provided on the periphery of the contour of the waterproof fabric 211; where water stains on the ground can be isolated outside the tent by the waterproof fabric 211 at the bottom of the tent, the above-mentioned gauze 212 can be connected to the periphery of the contour of the waterproof fabric 211 by a sewing thread, and the gauze 212 can also be connected to the body portion 11 of the flysheet 1 by a sewing thread, so that air can enter the inner cavity of the inner tent 2 and the body portion 11 of the flysheet 1 through the gauze 212.

It should be pointed out that, in practice, water stains on the ground are usually accumulated to a certain depth, and therefore, in practical design, when the inner tent 2 and the body portion 11 of the flysheet 1 are enclosed to form a closed inner cavity, the waterproof fabric 211 should be correspondingly bent and extend to a certain height in a direction away from the ground. In this regard, according to the above-mentioned technical solution of the present application, a bending line is further provided in an upper waterproof fabric 211, where the bending line (as shown by a broken line Y in FIG. 2) is used for bending the waterproof fabric 211 to obtain a horizontal portion 2111 arranged horizontally and a bending portion 2112 connected to the body portion 11 when the inner tent 2 and the body portion 11 of the flysheet 1 enclose to form an inner cavity, and the bending portion 2112 has a certain height compared with the ground to further improve the waterproof performance of a tent pitched with the multi-functional curtain.

Embodiment I

Referring to FIGS. 1 and 2, in the present embodiment, the multi-functional curtain designed by the present application includes an flysheet 1 and an inner tent 2. The flysheet 1 is specifically formed with six corners 3 all having two outer tent rims 13 extending at an included angle to another adjacent corner 3, and each corner 3 is provided with an anchor point member for connecting a guy line, a tent stake or a support stem; that is to say, there are six outer tent rims 13 in total in the flysheet 1 of the present embodiment.

It should be pointed out that in the present embodiment, the flysheet 1 includes in particular a body portion 11 and two outer tent curtain portions 12 arranged symmetrically and connected to each other. The body portion 11 of the flysheet 1 is a quadrangular body portion 11, the two outer tent curtain portions 12 are both triangular curtains, the two outer tent curtain portions 12 are respectively connected to two adjacent rims of the body portion 11, and the body portion 11 has and only has two outer tent rims 13, and the above-mentioned two outer tent curtain portions 12 also have and only have two outer tent rims 13 respectively.

As shown in FIG. 1, in the present embodiment, one outer tent rim 13 of the two outer tent curtain portions 12 is respectively connected to the two outer tent rims 13 of the body portion 11, while the other outer tent rim 13 of the two outer tent curtain portions 12 is connected to each other, and the corner 3 formed by the connection of the two outer tent curtain portions 12 is the connection corner 31 of the body portion 11 of the flysheet 1 and the two outer tent curtain portions 12, i.e., a connection point of the two outer tent curtain portions 12 and the body portion 11 where the outer tent rims 13 of the two outer tent curtain portions 12 are connected.

It should be noted that in the present embodiment, an angular bisector of the corner 3 formed where the outer tent rims 13 of the two outer tent curtain portions 12 are connected is a symmetry axis of the two outer tent curtain portions 12, and the above-mentioned body portion 11 can also be symmetrical up and down along the above-mentioned angular bisector, i.e., the flysheet 1 of the multi-functional curtain designed in the present application can be symmetrically arranged up and down along the angular bisector of the corner 3 formed where the outer tent rims 13 of the two outer tent curtain portions 12 are connected.

Accordingly, as can be seen referring to FIG. 2, in the present embodiment, the inner tent 2 specifically includes a tent bottom 21 and an inner tent curtain portion 22, the tent bottom 21 is specifically a quadrangular tent bottom 21, and the inner tent curtain portion 22 is specifically a triangular inner tent curtain, and the horizontal projection area of the tent bottom 21 is smaller than the horizontal projection area of the body portion 11 of the flysheet 1, so that the quadrangular tent bottom 21 can be arranged in the body portion 11 of the flysheet 1.

In the present embodiment, the tent bottom 21 of the above-mentioned inner tent fabric 2 includes two first inner tent rims 213 and two second inner tent rims 214, where the two first inner tent rims 213 are detachably connected to the body portion 11, and the two second inner tent rims 214 are connected to the body portion 11; the inner tent curtain portion 22 includes a first tent curtain rim 221 and two second tent curtain rims, where the first tent curtain rim 221 is detachably connected to the tent bottom 21 and the two second tent curtain rims are connected to the body portion 11 of the flysheet 1.

When provided, one fabric corner of the quadrangular waterproof fabric base 21 can be detachably connected to the above-mentioned connection corner 31, and the connection corner 31 is provided with a quick-release means, so that two inner waterproof fabric rims of the fabric corner, i.e., two first inner waterproof fabric rims 213 can be detachably connected to the connection corner 31 via the quick-release means, while the other two second inner waterproof fabric rims 214 of the quadrangular inner tent 2 are all connected to the body portion 11 of the outer waterproof fabric rim 13 via a sewing thread, thereby ensuring that the above-mentioned fabric corner of the quadrangular waterproof fabric base 21 is detached from the connection corner 31 on the body portion 11; after the two first inner tent rims 213 of the quadrangular tent bottom 21 are separated from the body portion 11, the quadrangular tent bottom 21 and the triangular inner tent curtain can enclose to form an inner cavity with the body portion 11 of the flysheet 1.

In the present embodiment, the quadrangular tent bottom 21 of the inner tent 2 and the triangular inner tent curtain are also symmetrically arranged up and down along the angular bisector of the corner 3 formed by a connection of the two outer tent curtain portions 12.

It should note that, in the present embodiment, the second inner tent rim 214 of the tent bottom 21 and the second tent curtain rim of the inner tent curtain portion 22 are designed to be stitched to the body portion 11 of the flysheet 1 by a sewing thread. In addition, the broken line X shown in FIG. 1 is a stitching thread between the tent bottom 21 of the inner tent 2 and the body portion 11 of the flysheet 1.

Further revering to FIG. 2, it can be seen that in the present embodiment, the inner tent 2 specifically includes a waterproof fabric 211 and a gauze 212, where the gauze 212 is stitched to the periphery of the waterproof fabric 211 by a sewing thread, and the gauze 212 is further stitched to the body portion 11 of the flysheet 1 by a sewing thread. In the present embodiment, the waterproof fabric 211 further has a bending line therein, and the broken line Y shown in FIG. 2 is a bending line for bending the waterproof fabric 211 to obtain a horizontal portion 2111 arranged horizontally and a bending portion 2112 connected to the gauze 212 when the inner tent 2 and the body portion 11 enclosed to form an inner cavity.

Accordingly, in the present embodiment, in order to optimize the use effect of the inner tent curtain portion 22, the inner tent curtain portion 22 may also be provided with a waterproof zipper 224, so that a user can open or close the tent bottom 21 and the closed inner cavity of the inner tent curtain portion 22 and the body portion 11 by pulling to open or pulling the waterproof zipper 224 on the inner tent curtain. In practice, in order to improve the ventilation effect, the structure of the inner tent curtain portion 22 can also be improved, so that the inner tent curtain portion 22 includes an air-permeable screen window 222 and a guard 223, where the above-mentioned air-permeable screen window 222 is connected to the guard 223, and the guard 223 is provided at one end of the inner tent curtain portion 22 connected to the tent bottom 21, and the above-mentioned air-permeable screen window 222 is provided at one end of the inner tent curtain portion 22 connected to the body portion 11 of the flysheet 1. With this design, when the above-mentioned inner tent curtain portion 22 forms a closed inner cavity together with the tent bottom 21 and the body portion 11, it is still possible to exchange air with the external environment through the air-permeable screen window 222, in which case the two outer tent curtain portions 12 of the flysheet 1 of the multi-functional curtain can hang up, so as not to affect the air-permeability of the air-permeable screen window 222.

In addition, as shown in FIG. 5, when the multi-functional curtain is pitched into a tent, since a bending line Y is provided on the tent bottom 21 of the inner tent 2, when the tent bottom 21 is bent, an inclined triangular semi-open cavity a (such as the semi-open cavity a shown in FIG. 5) exists between at least some of the fabric pieces on two sides of the tent bottom 21 and the body portion 11, and the triangular semi-open cavity a is used to increase air permeability.

In addition, further referring to FIG. 5, it can be seen that when the multi-functional curtain is pitched into a tent, the inner tent curtain portion 22 can be unfolded normally to assume a triangular shape; however, when the multi-functional curtain does not pitch a tent, the user receives the multi-functional curtain, and the closed inner cavity enclosed by the inner tent 2 and the body portion 11 disappears, the connection end of the triangular inner tent curtain portion 22 and the inner tent 2 deform at the same time and form a folded area, so that when the first inner tent rim 213 of the tent bottom 21 is connected to the body portion 11, the inner tent curtain portion 22 overlaps between the interlayer of the tent bottom 21 and the body portion 11 (as shown in FIG. 2).

Of course, in some preferred embodiments, it is also possible to provide an arched rod in the body portion 11 of the flysheet 1 and to pass the arched rod in the body portion 11 to enhance the strength and rigidity of the inner cavity in the tent and improve the comfort of the inner cavity space when the multi-functional curtain of the present embodiment is pitched into a tent, which is well known to a person skilled in the art and will not be described further herein.

Embodiment II

As shown in FIGS. 8 and 9, in the multi-functional curtain designed in Embodiment II, the basic arrangement of the multi-functional curtain in Embodiment II is completely the same as that in Embodiment I, but the structure of the curtain in Embodiment II is still different from that in Embodiment I, and the difference therebetween is as follows: the shapes of the body portion 11 of the flysheet 1 and the tent bottom 21 of the inner tent 2 of Embodiment II are different from those of Embodiment I.

In the present embodiment, the flysheet 1 is formed with eight corners 3, and the flysheet 1 specifically includes: the hexagonal body portion 11 and two triangular outer tent curtains, and the two outer tent curtain portions 12 are also connected to two sides adjacent to the body portion 11 (as shown by a dotted line Z in FIG. 1), while the corner 3 formed by the connection of the outer tent rims 13 of the two outer tent curtain portions 12 is a connection corner 31.

In the present embodiment, the inner tent 2 includes: a hexagonal tent bottom 21 and two triangular inner tent curtains; in addition, when provided, both the hexagonal tent bottom 21 and the hexagonal body portion 11 can be symmetrically arranged up and down along an angular bisector of the corner 3 formed by the connection of the two outer tent curtain portions 12.

Accordingly, other means for arranging the multi-functional curtain of Embodiment II can be seen from the above-mentioned Embodiment I, and the design principle thereof is the same and therefore will not be described in detail.

Of course, it is important to point out that the two technical solutions of the above-mentioned Embodiment I and Embodiment II are merely differences in the shape of the fabric of the body portion 11 of the flysheet 1 and the tent bottom 21 of the inner tent 2 used, and in practice, the shape of the above-mentioned fabric is not particularly limited, and a suitable shape can be selected and designed according to corresponding application scenarios; at the same time, the above-mentioned Embodiment I and Embodiment II only disclose a triangular structure form of the tent curtain, and it should be noted that in practice, the outer tent curtain portion 12 and the inner tent curtain portion 22 can also be design to get other forms of derivative products according to specific application requirements, which will not be described in detail herein.

Embodiment III

Figure 3:
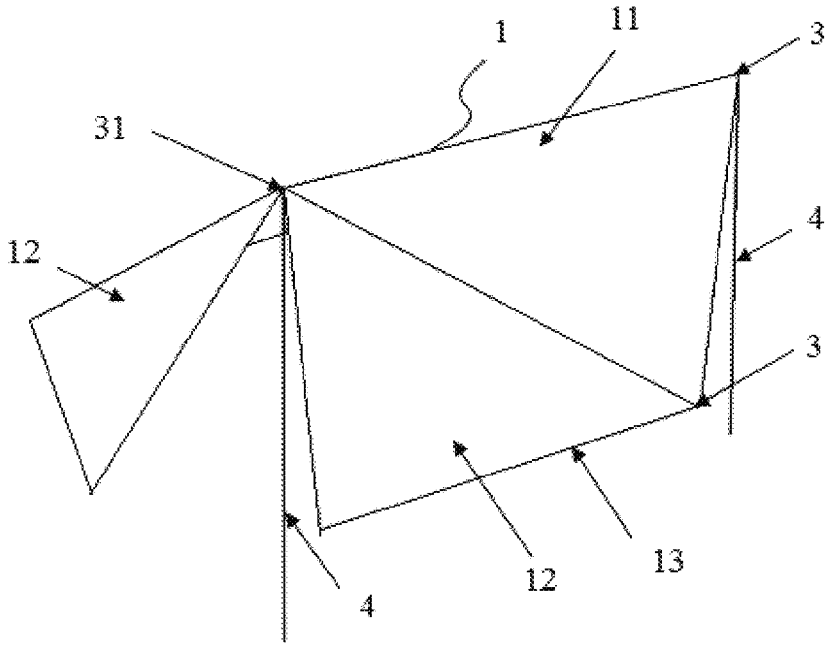
FIG. 3 is a schematic structural diagram showing a camping tarp pitched with the multi-functional curtain as shown in FIG. 1.

As shown in FIG. 3, in the present embodiment, the present application discloses a camping tarp by using the multi-functional curtain of the above-mentioned Embodiment I, where the camping tarp specifically includes two support stems 4 with a length of 2.0 m, a plurality of guy lines and the multi-functional curtain of the above-mentioned Embodiment I. In practice, all the inner tent rims of the tent bottom 21 of the inner tent 2 of the above-mentioned multi-functional curtain are connected to the body portion 11 of the flysheet 1, and the inner tent curtain portion 22 of the inner tent is specifically accommodated between the interlayer of the tent bottom 21 and the body portion 11 to avoid an inner cavity enclosed between the inner tent 2 and the body portion 11.

When the camping tarp is pitched, one support stem 4 is fixedly connected to the anchor point member at the corner 3 formed by the two outer tent rims 13 of the body portion 11 of the flysheet 1, and the other support stem 4 is fixedly connected to the anchor point member at the corner 3 formed by the connection of the outer tent rims 13 of the two outer tent curtain portions 12 of the flysheet 1 (i.e., the connection corner 31), and at the same time, one end of the two support stems 4 away from the above-mentioned multi-functional curtain is fixed to the ground.

Accordingly, the remaining anchor point members on the flysheet 1 of the above-mentioned multi-functional curtain are connected to a guy line, and one end of the guy line away from the above-mentioned multi-functional curtain is fixed to the ground to realize the pitching of the camping tarp.

Embodiment IV

Figure 4:
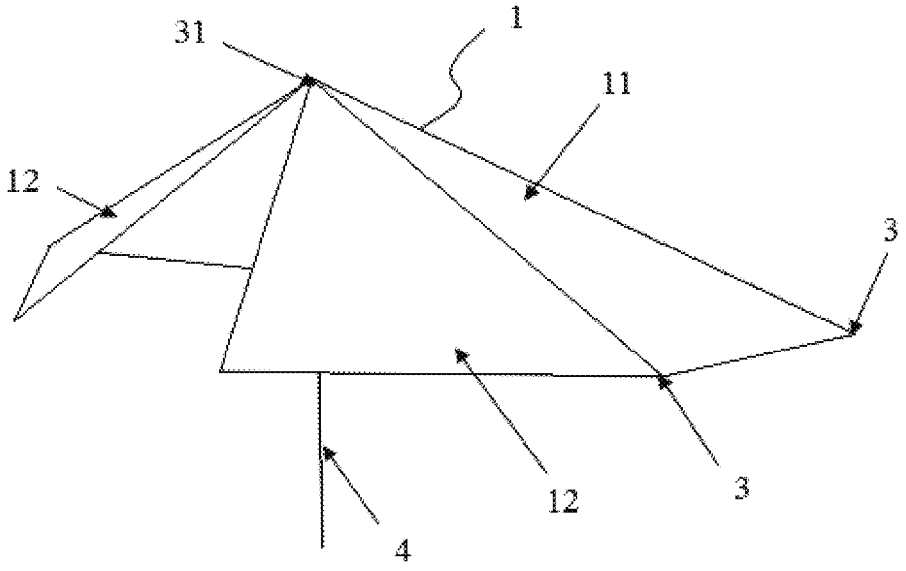
FIG. 4 is a schematic structural diagram showing another camping tarp pitched with the multi-functional curtain as shown in FIG. 1.

As shown in FIG. 4, in the present embodiment, the present application discloses another camping tarp by using the multi-functional curtain of the above-mentioned Embodiment I, where the camping tarp specifically includes one support stem 4 with a length of 2.6 m, a plurality of guy lines and the multi-functional curtain of the above-mentioned Embodiment I. In practice, all the inner tent rims of the tent bottom 21 of the inner tent 2 of the above-mentioned multi-functional curtain are connected to the body portion 11 of the flysheet 1, and the inner tent curtain portion 22 of the inner tent is specifically accommodated between the interlayer of the tent bottom 21 and the body portion 11 to avoid an inner cavity enclosed between the inner tent 2 and the body portion 11.

In pitching the camping tarp, one end of the support stem 4 is fixedly connected to an anchor point member at a corner 3 (i.e., a connection corner 31) formed by the connection of the outer tent rims 13 of the two outer tent curtain portions 12 of the flysheet 1, and at the same time, the other end of the support stem 4 away from the above-mentioned multi-functional curtain is fixed to the ground. Accordingly, the remaining anchor point members on the flysheet 1 of the above-mentioned multi-functional curtain are connected to a guy line, and one end of the guy line away from the above-mentioned multi-functional curtain is fixed to the ground to realize the pitching of the camping tarp.

Embodiment V

As shown in FIGS. 5-7, in the present embodiment, the present application discloses a tent pitched by using the multi-functional curtain of the above-mentioned Embodiment I, the tent specifically including a support stem 4 with a length of 1.4 m, a plurality of tent stakes and the multi-functional curtain of the above-mentioned Embodiment I.

In practice, on the flysheet 1 of the multi-functional curtain, the corner 3 formed by the connection of the two outer tent curtain portions 12 is a connection corner 31 of the body portion 11 of the flysheet 1 and the two outer tent curtain portions 12; in addition, the fabric corner of the quadrangular tent bottom 21 detachably connected to the above-mentioned connection corner 31 can be quickly removed by a quick-release means, so that the two first inner tent rims 213 extending at an included angle of the fabric corner are detached and separated from the body portion 11 of the flysheet 1, while the other two second inner tent rims 214 of the quadrangular tent bottom 21 are still connected to the body portion 11 of the outer tent rim 13, and at this time, the quadrangular tent bottom 21 of the inner tent 2 can be grounded and insulated from the ground, and the inner tent curtain portion 22 connected to the above-mentioned quadrangular tent bottom 21 can be fallen to be unfolded with the above-mentioned tent bottom 21 being grounded to ensure that the tent bottom 21 of the inner tent 2, the inner tent curtain portion 22 and the body portion 11 of the flysheet 1 to enclose to form a closed inner cavity.

In pitching the camping tarp, the support stem 4 is fixedly connected to the anchor point member of the corner 3 formed where the outer tent rims 13 of the two outer tent curtain portions 12 of the flysheet 1 are connected, while the end of this support stem 4 away from the above-mentioned multi-functional curtain is fixed to the ground. Accordingly, in the multi-functional curtain, the remaining anchor point members on the body portion 11 of the flysheet 1 are fixed to the ground through tent stakes, so that the tent can be pitched.

In summary, it can be seen that the multi-functional curtain designed in the present application is easy to install and use; the multi-functional curtain achieves a multi-purpose of one product under different scenarios and requirements, i.e., the multi-functional curtain can not only be pitched to obtain a camping tarp, but also can be pitched to obtain a tent; an article can be pitched to obtain two important necessities (a camping tarp and a tent) to be able to cope with outdoor complex and varied scenarios; in addition, the multi-functional curtain has the advantages of light weight, being easy to carry, being easy to pitch and good applicability, which can meet the user's requirements for the lightness of outdoor equipment and make the user get better outdoor experience.

The above-mentioned embodiments are merely examples of the present application and are not intended to limit the scope of the present application, and all changes which come within the meaning and range of equivalence of the present application and the appended claims are to be embraced within their scope.

What is claimed is:

1. A multi-functional curtain, comprising:

an flysheet, comprising a body portion and two outer tent curtain portions arranged symmetrically, wherein the body portion and the two outer tent curtain portions are connected to each other; and an inner tent, comprising a tent bottom and an inner tent curtain portion, wherein a tent curtain rim of the inner tent curtain portion is respectively connected to the tent bottom and the body portion; the inner tent is arranged in the body portion, and the tent bottom has a first inner tent rim detachably connected to the body portion, so that the tent bottom, the inner tent curtain portion and the body portion enclose an inner cavity after the first inner tent rim being separated from the body portion;

wherein the flysheet is formed with a plurality of corners, each of the corners has two outer tent rims extending at an included angle to another adjacent corner, and each corner is further provided with an anchor point member for connecting a guy line, a tent stake or a support stem; at least one of the corners is a connection corner of the body portion with two of the outer tent curtain portions, and a first inner tent rim of the tent bottom is detachably connected with the connection corner; and the connection corner is provided with a quick-release means, and the first inner tent rim of the tent bottom is detachably connected to the connection corner via the quick-release means.

2. The multi-functional curtain according to claim 1, wherein the flysheet is formed with six corners, the body portion is a quadrangular body portion, the two outer tent curtain portions are triangular outer tent curtains, the two outer tent curtain portions are respectively connected with two adjacent rims of the body portion, and the corner formed where the outer tent rims of the two outer tent curtain portions are connected is the connection corner.

3. The multi-functional curtain according to claim 2, wherein the tent bottom is a quadrangular tent bottom and the inner tent curtain portion is a triangular inner tent curtain;

the tent bottom comprises the two first inner tent rims and the two second inner tent rims, the two first inner tent rims are detachably connected to the body portion, and the two second inner tent rims are connected to the body portion; and the inner tent curtain portion comprises a first tent curtain rim and two second tent curtain rims, the first tent curtain rim is connected to the tent bottom and the two second tent curtain rims are connected to the body portion.

4. The multi-functional curtain according to claim 3, wherein the second inner tent rim of the tent bottom and the second tent curtain rim of the inner tent curtain portion are stitched to the body portion by a sewing thread.

5. The multi-functional curtain according to claim 1, wherein the flysheet is formed with eight corners, the body portion is a hexagonal body portion, the two outer tent curtain portions are triangular outer tent curtains, the two outer tent curtain portions are respectively connected with two adjacent rims of the body portion, and the corner formed where the outer tent rims of the two outer tent curtain portions are connected is the connection corner.

6. The multi-functional curtain according to claim 5, wherein the tent bottom is a hexagonal tent bottom and the inner tent curtain portion is a triangular inner tent curtain;

the tent bottom comprises the two first inner tent rims and four second inner tent rims, the two first inner tent rims are detachably connected to the body portion, and the four second inner tent rims are connected to the body portion; and the inner tent curtain portion comprises a first tent curtain rim and two second tent curtain rims, the first tent curtain rim of the inner tent curtain portion is connected to the tent bottom and the two second tent curtain rims are connected to the body portion.

7. The multi-functional curtain according to claim 6, wherein the second inner tent rim of the tent bottom and the second tent curtain rim of the inner tent curtain portion are stitched to the body portion by a sewing thread.

8. The multi-functional curtain according to claim 1, wherein the tent bottom comprises a waterproof fabric and a gauze for connection with the body portion, the gauze is provided at the periphery of a contour of the waterproof fabric; and the waterproof fabric further has a bending line therein, and the bending line is used for bending the waterproof fabric to obtain a horizontal portion arranged horizontally and a bending portion connected to the gauze when the tent bottom, the inner tent curtain portion and the body portion enclose an inner cavity.

9. A camping tarp, comprising at least one support stem, a guy line and the multi-functional curtain according to claim 1, wherein all the inner tent rims of the tent bottom of the inner tent of the multi-functional curtain are connected to the body portion;

the inner tent curtain portion of the inner tent is accommodated between the tent bottom and the body portion interlayer, and at least one of the support stems is connected to at least one anchor point member on the flysheet of the multi-functional curtain to support the multi-functional curtain; and the remaining anchor point members on the flysheet are connected to a guy line, and an end of the guy line away from the flysheet is fixed to the ground.

10. A tent, comprising a support stem, tent stakes and the multi-functional curtain according to claim 1, wherein the first inner tent rim of the tent bottom of the inner tent of the multi-functional curtain is separated from the body portion, so that the tent bottom of the inner tent, the inner tent curtain portion and the body portion enclose the inner cavity; and the support stem is connected to the anchor point member provided at the connection corner to support the multi-functional curtain; and the remaining anchor point members on the body portion are fixed to the ground by the tent stakes.

11. A multi-functional curtain, comprising:

an flysheet, comprising a body portion and two outer tent curtain portions arranged symmetrically, wherein the body portion and the two outer tent curtain portions are connected to each other; and an inner tent, comprising a tent bottom and an inner tent curtain portion, wherein a tent curtain rim of the inner tent curtain portion is respectively connected to the tent bottom and the body portion; the inner tent is arranged in the body portion, and the tent bottom has a first inner tent rim detachably connected to the body portion, so that the tent bottom, the inner tent curtain portion and the body portion enclose an inner cavity after the first inner tent rim being separated from the body portion;

wherein the flysheet is formed with a plurality of corners, each of the corners has two outer tent rims extending at an included angle to another adjacent corner, and each corner is further provided with an anchor point member for connecting a guy line, a tent stake or a support stem; at least one of the corners is a connection corner of the body portion with two of the outer tent curtain portions, and a first inner tent rim of the tent bottom is detachably connected with the connection corner;

the flysheet is formed with eight corners, the body portion is a hexagonal body portion, the two outer tent curtain portions are triangular outer tent curtains, the two outer tent curtain portions are respectively connected with two adjacent rims of the body portion, and the corner formed where the outer tent rims of the two outer tent curtain portions are connected is the connection corner;

the tent bottom is a hexagonal tent bottom and the inner tent curtain portion is a triangular inner tent curtain;

the tent bottom comprises the two first inner tent rims and four second inner tent rims, the two first inner tent rims are detachably connected to the body portion, and the four second inner tent rims are connected to the body portion; and the inner tent curtain portion comprises a first tent curtain rim and two second tent curtain rims, the first tent curtain rim of the inner tent curtain portion is connected to the tent bottom and the two second tent curtain rims are connected to the body portion.

12. The multi-functional curtain according to claim 11, wherein the second inner tent rim of the tent bottom and the second tent curtain rim of the inner tent curtain portion are stitched to the body portion by a sewing thread.

13. The multi-functional curtain according to claim 11, wherein the tent bottom comprises a waterproof fabric and a gauze for connection with the body portion, the gauze is provided at the periphery of a contour of the waterproof fabric; and the waterproof fabric further has a bending line therein, and the bending line is used for bending the waterproof fabric to obtain a horizontal portion arranged horizontally and a bending portion connected to the gauze when the tent bottom, the inner tent curtain portion and the body portion enclose an inner cavity.

14. A camping tarp, comprising at least one support stem, a guy line and the multi-functional curtain according to claim 11, wherein all the inner tent rims of the tent bottom of the inner tent of the multi-functional curtain are connected to the body portion;

the inner tent curtain portion of the inner tent is accommodated between the tent bottom and the body portion interlayer, and at least one of the support stems is connected to at least one anchor point member on the flysheet of the multi-functional curtain to support the multi-functional curtain; and the remaining anchor point members on the flysheet are connected to a guy line, and an end of the guy line away from the flysheet is fixed to the ground.

15. A tent, comprising a support stem, tent stakes and the multi-functional curtain according to claim 11, wherein the first inner tent rim of the tent bottom of the inner tent of the multi-functional curtain is separated from the body portion, so that the tent bottom of the inner tent, the inner tent curtain portion and the body portion enclose the inner cavity; and the support stem is connected to the anchor point member provided at the connection corner to support the multi-functional curtain; and the remaining anchor point members on the body portion are fixed to the ground by the tent stakes.

* * * * *